United States Patent [19]

Lowther

[11] 4,287,624

[45] Sep. 8, 1981

[54] AUXILIARY FLOTATION GEAR FOR FISHING BOATS

[76] Inventor: Lou Y. Lowther, San Antonio, Tex.

[21] Appl. No.: 11,797

[22] Filed: Feb. 14, 1979

[51] Int. Cl.[3] ..... B63B 35/00

[52] U.S. Cl. ..... 9/1.1; 9/1.7; 114/123

[58] Field of Search ..... 9/1.7, 6 P, 1.1, 3; 114/123, 114, 68, 69

[56] References Cited

U.S. PATENT DOCUMENTS

| | | | |
|---|---|---|---|
| 1,095,556 | 5/1914 | Danko et al. | 9/3 |
| 1,220,876 | 3/1917 | Moore | 9/3 |
| 1,736,157 | 11/1929 | Harter | 114/123 |
| 1,833,326 | 11/1931 | Krolman | 9/3 |
| 1,948,831 | 2/1934 | Sobieralski | 9/2 S |
| 2,494,804 | 1/1950 | Gabriel | 114/123 |
| 2,919,451 | 1/1960 | Long | 9/3 X |
| 3,840,926 | 10/1974 | Stoeberl | 9/6 P |
| 4,060,864 | 12/1977 | Woolworth | 114/123 |
| 4,129,911 | 12/1978 | McDonald et al. | 9/1.7 |

FOREIGN PATENT DOCUMENTS

| | | | |
|---|---|---|---|
| 29451 | of 1904 | United Kingdom | 114/123 |

*Primary Examiner*—George E. A. Halvosa
*Attorney, Agent, or Firm*—Gunn, Lee & Jackson

[57] ABSTRACT

This invention primarily resides in two float wings of substantially triangular contoured construction conforming to the hull of the boat securely affixed to the exterior stern of a fishing boat above the water line. Float wings may be constructed of expanded plastic having high buoyancy qualities such as expanded polystyrene or polyurethane. Any plastic producing a closed cell, rigid foam may be utilized. For durability, the foam is preferably covered with a fabric such as nylon reinforced vinyl or other suitable, durable fabric. The wings are securely attached to the hull of the boat with the base of the triangular structure projecting substantially normal to the hull. Auxiliary floats may be attached interior of the hull adjacent the bow to aid flotation and stability should the boat be swamped.

1 Claim, 5 Drawing Figures

AUXILIARY FLOTATION GEAR FOR FISHING BOATS

BACKGROUND OF THE INVENTION

1. Field of the Invention

This invention pertains to auxiliary flotation gear secured adjacent the stern of a fishing boat designed to stabilize the boat and add buoyancy in the event the boat is swamped. Auxiliary floats may also be secured interior of the boat adjacent the bow. The bow flotation members function principally to maintain buoyancy in the bow in the event of swamping.

2. Description of Prior Art

Outriggers as auxiliary flotation gear such as the native outrigger canoe of the Pacific Islanders are centuries old. Auxiliary flotation gear interior of the boat's hull are common in small sailboats as well as auxiliary flotation gear being constructed as a part of the seat in aluminum V hull fishing boats. Sponsons having buoyant qualities are well known and widely used in inboard and outboard racing boats. The distinction of this invention primarily resides in the contoured triangular stern flotation wings attached to the exterior of the boat hull on both sides of the hull adjacent the stern. Another distinction is the fact that this appendage does not inhibit nor interfere with movement to and fro nor storage availability within the boat. These flotation wings are attached above the water line and normally do not contact the water other than in rough weather generating a wave condition or when the boat is tipped.

A disclosure document briefly describing this invention dated Feb. 22, 1977, was filed in the U.S. Patent and Trademark Office as Disclosure Document No. 058365.

SUMMARY OF THE INVENTION

This invention primarily resides in the two flotation wings attached adjacent the stern of a fishing boat. These wings are of a substantially triangular, contoured construction conforming to the contour of the boat and securely affixed to the exterior of the stern of the boat above the water line. These flotation wings are rigidly secured, preferably by a rod-like structure such as a bolt projecting through the flotation wing and might use as an additional means of attachment any type of waterproof adhesive. Flotation wings may be constructed of expanded plastics having high buoyancy qualities such as expanded polystyrene or polyurethane. Any plastic producing a closed cell, rigid foam, may be utilized. For durability, the foam is preferably covered with a fabric such as nylon reinforced vinyl or other suitably durable fabrics to increase strength of the structure and encase the closed cell, rigid foam. A satisfactory method of attaching the stern flotation wings could be the construction of a grommet in the exterior fabric. A flotation sleeve projects through the body of the expanded, rigid foam filler in conjunction with a bolt having a shoulder to stabilize against the hull of the boat. A sealing bushing surrounds the bolt at the point it projects through the hull of the boat. An interior washer and nut firmly attach the bolt to the hull of the boat. This invention is primarily designed for utilization in conjunction with an aluminum V bottom fishing boat to enhance buoyancy and enhance stability should the occupant of the boat stand.

Auxiliary floats may be attached interior of the hull of the boat adjacent the bow. These bow floats are useful principally in the event of swamping of the boat and also serve as a comfortable decorative structure adjacent the bow of the boat. Tests conducted with the preferred embodiment demonstrate the unusual stability of a boat equipped with this auxiliary flotation gear as well as demonstrating that the auxiliary buoyancy will support the boat and an occupant even when the boat was completely swamped and filled with water.

BRIEF DESCRIPTION OF THE DRAWINGS

For a description of this invention, reference is made to the attached several views wherein identical reference characters will be utilized to refer to identical or equivalent components throughout the several views and the following detailed description.

DESCRIPTION OF THE PREFERRED EMBODIMENT

Figure 1:
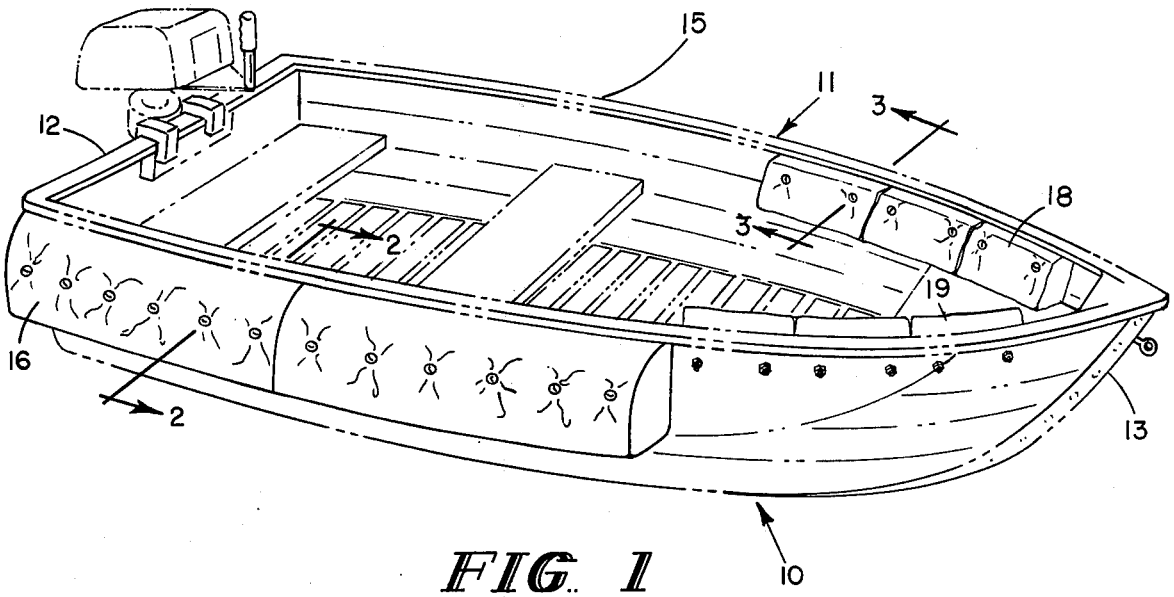
FIG. 1 is a perspective, top view of a fishing boat with the two stern flotation wings attached and the bow flotation members secured to the interior of the boat hull.
Figure 2:
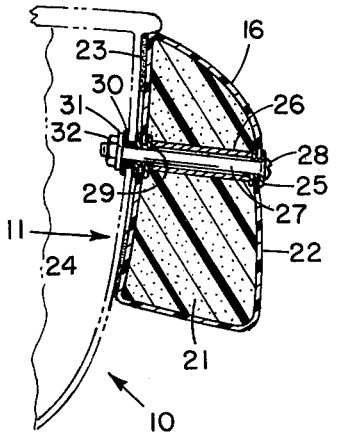
FIG. 2 is a fragmented, sectional view of the stern area of the boat substantially along the line 2—2 of FIG. 1 looking in the direction of the arrows illustrating a section of the right stern flotation wing as well as a means for attaching the wings securely to the hull of the boat.
Figure 4:
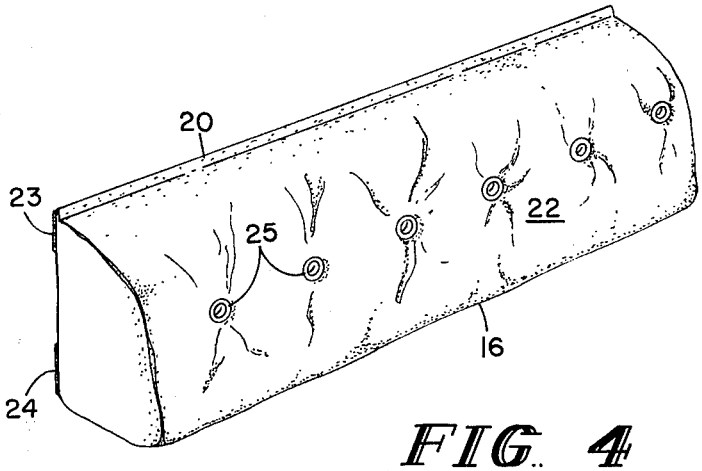
FIG. 4 is a fragmented, perspective view of the right stern flotation wing illustrating its general configuration detached from the boat.
Figure 5:
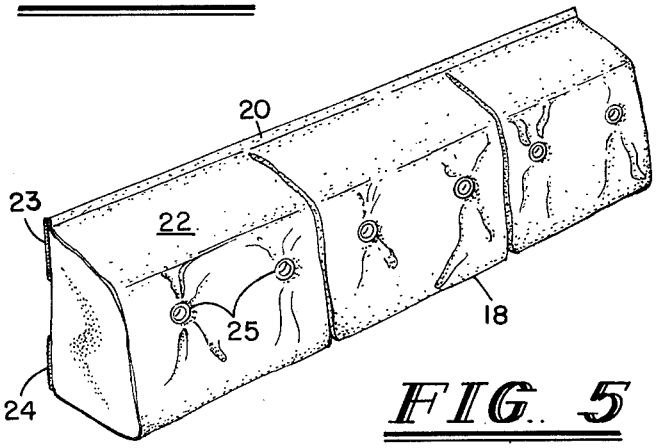
FIG. 5 is a fragmented, perspective view of the left interior flotation member designed for attaching adjacent the bow of the boat.
Figure 3:
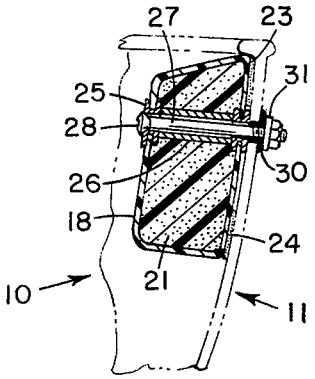
FIG. 3 is a fragmented, sectional view adjacent the left bow area of the boat taken substantially along line 3—3 of FIG. 1 looking in the direction of the arrows.

The preferred embodiment of this invention was initially constructed and utilized in a configuration as illustrated in FIG. 1. The fishing boat 10 is of aluminum construction in a V bottom design well known and widely utilized. The devices of the invention are attached to the hull 11 of the boat exterior of the stern 12 of the boat and interior of the bow 13 in the combination generally illustrated in FIG. 1. The left stern flotation wing 15 is essentially a mirrored image of a right stern flotation wing 16 as illustrated in detail in FIG. 1, FIG. 2 and FIG. 4. This mirrored configuration is also present in the left bow flotation member 18 and the right bow flotation member 19. The exterior as well as the cross sectional construction of the left bow flotation member 18 is illustrated in detail in FIGS. 3 and 5. In the preferred embodiment, the left stern flotation wing 15 and the right stern flotation wing 16 were 48" long. The dimensions of the cross sectional view of the right stern flotation wing 16 as illustrated in FIG. 2 had a height of approximately 10", a base of approximately 6", and an arcuate hypotenuse of approximately 13". These dimensions may, of course, be increased or decreased as desired. They are given primarily to assist in visualization and understanding of the general configuration of the structure. The interior of the flotation wings and the bow flotation members were constructed from an expanded, rigid foam filler 21. Any of a wide variety of expanded, rigid foam plastics such as polystyrene or polyurethane may be satisfactorily used. Chemicals which normally employ two components could be injected into molds of the desired configuration wherein they expand, creating water impervious trapped air cells. Any type of durable, rigid closed cell, rigid foam which is water impervious having high buoyancy properties may be uilitized as the rigid foam filler 21. In the construction of the preferred embodiment, the float cover 22 employed a vinyl coated nylon fabric. A heat weld seam 20 may be used or stitching may be used. In the construction, any durable fabric to stabilize and protect the rigid foam filler 21 might be utilized. To facilitate attaching the left stern floating wing 15 and the right stern floating wing 16, a water impervious adhesive may be placed on the float wings as upper adhesive 23 and lower adhesive 24 as suggested and illustrated in FIGS. 2 and 4. These adhesives might be similar to the widely utilized, durable strip adhesive employed in attaching side molding to automobiles in the automotive industry. To add durability to the float cover 22, it would be desirable to construct grommets 25 in the flotation wings 15 and 16 and bow flotation members 18 and 19 as illustrated in FIGS. 2, 3, 4, and 5. These grommets 25 are securely attached to the float cover 22 at the point where the rigid float securing means projects through the expanded rigid foam filler 21. In the preferred embodiment, a float sleeve 26 was employed as illustrated in FIG. 2. Projecting through this grommet 25 and float sleeve 26 was a float bolt 27 having a flared, bolt head 28 and bolt shoulder 29 as illustrated in FIG. 2. This construction lends itself to attaching the left stern flotation wing and the right stern flotation wing to the hull 11 of a fishing boat 10 in a rigid manner through the hull 11 of the boat above the water line. A sealing bushing 30 of neoprene rubber or some compound such as Teflon or a silicone gel preferably should surround the bolt 27 at the point of projection through the hull 11 of the boat 10. A satisfactory method of securing may also employ an interior washer 31 and an interior nut 32 as illustrated in FIG. 2. A tightening of interior nut 32 pulls the bolt shoulder 29 securely against the hull 11 of the boat forming a water tight seal around the bolt 27. A similar method of securing might be employed on the left bow flotation member 18 and the right bow flotation member 19. However, less stable securing means could be substituted, particularly in the case of these interior flotation member 18 and 19 secured adjacent to the bow 13. It is, however, important that the left stern flotation wing 15 and the right stern flotation wing 16 be secured to the exterior of the stern of fishing boat 10 in a rigid, firm manner, either as employed in the preferred embodiment or utilizing other stable securing means.

OPERATION OF THE DEVICE

Tests were conducted on the fishing boat 10 equipped with stern flotation wings 15 and 16 and bow flotation members 18 and 19. The V bottom fishing boat 10 was determined to be quite stable even with an occupant standing upright in the boat. This additional stability is a safety factor as well as enhances the stability of the fishing boat 10 should a fisherman desire to stand in the boat for the purpose of making long casts. Additional safety in the utilization of the boat is accomplished in loading or unloading gear or passengers from a boat 10 so equipped. As previously mentioned, tests were conducted utilizing the devices of this invention and an aluminum fishing boat 10 so equipped continued to float with an occupant remaining in the boat even though the boat was forcefully swamped or filled with water. The boat remained in a stable, upright position complete with one passenger and small outboard motor attached.

Having described in detail the construction and configuration of the preferred embodiment and having alluded to various modifications, what is desired to be claimed is all embodiments and modifications of this invention falling within the equivalents of the appended claims.

I claim:

1. Auxiliary floating gear for a fishing boat having a hull comprising:

a. right and left elongated stern flotation wings adapted to be securely attached exteriorly adjacent the stern of said boat, said wings comprising rigid expanded plastic foam inner filler and a fabric float cover encasing said rigid foam filler;

b. right and left bow flotation members adapted to be securely attached interior and adjacent the bow of said boat, said bow flotation members comprising rigid expanded plastic foam inner filler and a fabric float cover encasing said rigid foam filler;

c. securing means for rigidly attaching said stern flotation wings and bow flotation members to said boat, said securing means comprising:

(1) an adhesive to be positioned between said wings and said flotation members and said boat;

(2) a grommet secured to said fabric float cover;

(3) a float sleeve projecting through said expanded rigid foam filler;

(4) a bolt projecting through said grommet and said float sleeve;

(5) means for rigidly affixing said bolt to said boat comprising a bolt shoulder adjacent said boat, a sealing bushing encircling said bolt adjacent said bolt shoulder, a washer encircling said bolt adjacent said boat hull, and a nut threadably engaging said bolt thereby securely affixing said bolt to the structure of said boat;

said right and left stern flotation wings being a substantially triangular construction, the height of said triangle following the contour of the hull of the boat adjacent the stern of the boat, the base of said substantially triangular float wings projecting substantially normal to the hull of said boat, and said right and left stern flotation wings being secured above the normal water line of the boat and projecting outward substantially normal to the hull of said boat.

* * * * *